US011187505B1

(12) United States Patent
Thielman

(10) Patent No.: US 11,187,505 B1
(45) Date of Patent: Nov. 30, 2021

(54) CONCATENATED ANNULAR SWING-WING TANDEM LIFT ENHANCER

(71) Applicant: Gerhard W. Thielman, Fredericksburg, VA (US)

(72) Inventor: Gerhard W. Thielman, Fredericksburg, VA (US)

( * ) Notice: Subject to any disclaimer, the term of this patent is extended or adjusted under 35 U.S.C. 154(b) by 298 days.

(21) Appl. No.: 16/503,208

(22) Filed: Jul. 3, 2019

(51) Int. Cl.
*F42B 10/14* (2006.01)

(52) U.S. Cl.
CPC ..... *F42B 10/14* (2013.01)

(58) Field of Classification Search
CPC . F02K 9/90; F41G 5/22; F41G 7/2213; F41G 7/222; F42B 10/14; F42B 10/143; F42B 10/146; F42B 10/16; F42B 10/18; F42B 10/20; F42B 10/22; F42B 10/24; F42B 10/26; F42B 10/28; F42B 10/30; F42B 10/64
USPC ..... 244/3.27
See application file for complete search history.

(56) References Cited

U.S. PATENT DOCUMENTS 667,048 A * 1/1901 Whitman ..... F42B 10/14 102/400
1,099,784 A * 6/1914 Bizas ..... F42B 10/14 102/400
3,004,489 A * 10/1961 Griffith ..... B64G 1/645 102/378
3,063,375 A * 11/1962 Hawley ..... F42B 10/14 244/3.27
3,127,838 A * 4/1964 Moratti ..... F42B 10/14 244/3.27
3,233,547 A * 2/1966 Fletcher ..... F42B 15/36 244/3.27
3,589,645 A * 6/1971 Haglund ..... F42B 10/16 244/3.27
3,602,459 A * 8/1971 Pesarini ..... F42B 10/14 244/3.27
4,135,686 A * 1/1979 Herpfer ..... F42B 10/50 244/3.27
4,453,426 A * 6/1984 Groutage ..... B64C 39/024 244/49
4,588,146 A * 5/1986 Schaeffel, Jr. ..... F42B 10/14 244/3.27
4,667,899 A * 5/1987 Wedertz ..... F42B 10/14 244/218

(Continued)

*Primary Examiner* — Joshua E Rodden

(57) ABSTRACT

A concatenated annular swing-wing tandem lift enhancer (CASTLE) is provided for augmenting aeronautical lift to a canister-launched missile. The CASTLE includes fore and aft housing sections and pluralities of mainstays, airfoils, wing grapples and tension supports. The fore and aft housing sections are disposed circumferentially around the missile along a longitudinal axis of symmetry. The front and rear mainstays are disposed angularly along each housing section. The airfoils stowed circumferentially around each the housing section. Each airfoil has an outer camber surface and an inner arc surface that provides leading and trailing edges ending at port and starboard tips. The wing grapples disposed on the inner arc surface. The supports connect the mainstays with corresponding the grapples such that the airfoils deploy radially outward and swing such that each leading edge faces forward in relation to the longitudinal axis. The supports can be flexible lanyards or else rigid struts.

6 Claims, 6 Drawing Sheets

(56) References Cited

U.S. PATENT DOCUMENTS

| | | | | |
|---|---|---|---|---|
| 5,615,632 | A * | 4/1997 | Nedderman, Jr. | F42B 10/14 114/330 |
| 8,985,504 | B2 * | 3/2015 | Tao | B64C 3/44 244/49 |
| 9,297,622 | B2 * | 3/2016 | Roy | F42B 10/64 |
| 10,401,134 | B2 * | 9/2019 | Trouillot | F42B 14/064 |
| 2003/0178527 | A1 * | 9/2003 | Eisentraut | F42B 10/14 244/3.28 |

* cited by examiner

CONCATENATED ANNULAR SWING-WING TANDEM LIFT ENHANCER

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to a lift-enhancing mechanism for a canister-launched missile. In particular, this invention relates to embedded wings on the missile exterior that can be unfurled.

Cruise missiles such as RGM-84 Harpoon and the BGM-109 Tomahawk operate for over-the-horizon ranges. The disclosure generally employs metric units with the following abbreviations: length in meters (m) or kilometers (km), mass in kilograms (kg), time in seconds (s) or hours (hr), angles in degrees (°) or radians (rad), force in newtons (N), temperature in kelvins (K), electric current in amperes (A), and energy in joules (J). The respective axi-symmetric diameter and length (including booster) of the Harpoon airframe are 0.34 m and 4.6 m, with a mass of 690 kg and a cruciform wingspan of 0.91 m. The respective axi-symmetric diameter and length (including booster) of the Tomahawk airframe are 0.52 m and 6.25 m, with a mass of 1600 kg and a horizontal wingspan of 2.67 m. The Harpoon and Tomahawk respectively travel at 860 km/hr for at least 124 km and 890 km/hr for between 1300 km and 2500 km depending on variant. The requirement for these missiles to be capable of canister launch, the wings must be folded for stowage.

SUMMARY

Conventional missile wings yield disadvantages addressed by various exemplary embodiments of the present invention. In particular, various exemplary embodiments provide a concatenated annular swing-wing tandem lift enhancer (CASTLE) for a canister-launched missile. The CASTLE includes fore and aft housing sections and pluralities of mainstays, airfoils, wing grapples and tension supports. The fore and aft housing sections are circumferentially disposed around the missile along a longitudinal axis of symmetry. The front and rear mainstays are disposed angularly along each housing section.

The airfoils circumferentially stowed around each the housing section. Each airfoil has an outer camber surface and an inner arc surface that provides leading and trailing edges ending at port and starboard tips. The wing grapples disposed on the inner arc surface in proximity to the port and starboard tips. The supports connect the mainstays with corresponding the grapples such that the airfoils deploy radially outward and swing such that each leading edge faces forward in relation to the longitudinal axis. The supports can be flexible lanyards or else rigid struts.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

The disclosure generally employs metric units with the following abbreviations: length in meters (m), mass in kilograms (kg), time in seconds (s), angles in degrees (°), force in newtons (N), and energy in joules (J).

Figure 1:
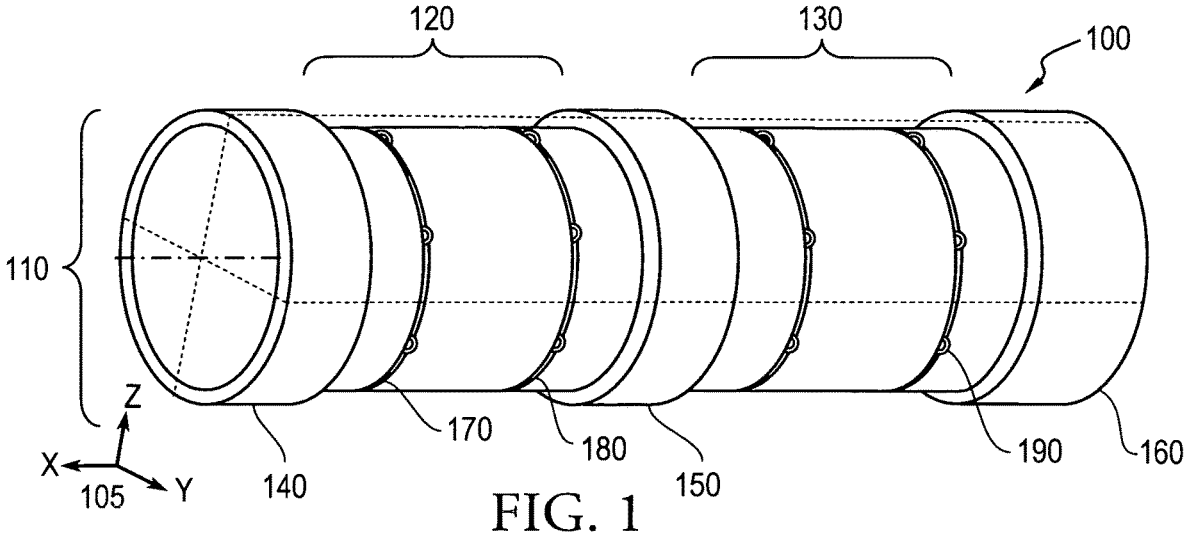
FIG. 1 is an isometric view of a missile portion with tandem recess sections.

FIG. 1 shows an isometric view 100 with a compass rose 105 of a missile portion 110 with tandem annular wing housing sections 120 and 130, fore and aft. The housing sections 120 and 130 can be recessed from the outer missile diameter depending on comparative room within the launch canister. The compass rose 105 indicates Cartesian orientation directions: X forward (axial), Y port (lateral) and Z upward (azimuth), with airframe rotation in roll along the X axis of symmetry, in pitch along the Y axis, and in yaw along the Z axis, with air flowing opposite the missile's travel in the direction of the X axis.

For a missile configuration such as Tomahawk, the fore recess housing section 120 can be disposed in mid-body surrounding the fuel tank between a fore portion 140 containing the payload and a mid portion 150, such as the aft body. The aft recess housing section 130 can be located adjacent propulsion between the mid portion 150 and an aft portion 160 such as propulsion or the motor (for boost). The housing sections 120 and 130 can include upstream and downstream channel bands 170 and 180 to contain mainstays 190 shown as anchor hooks onto which to attach lanyards for securing airfoils.

Figure 2:
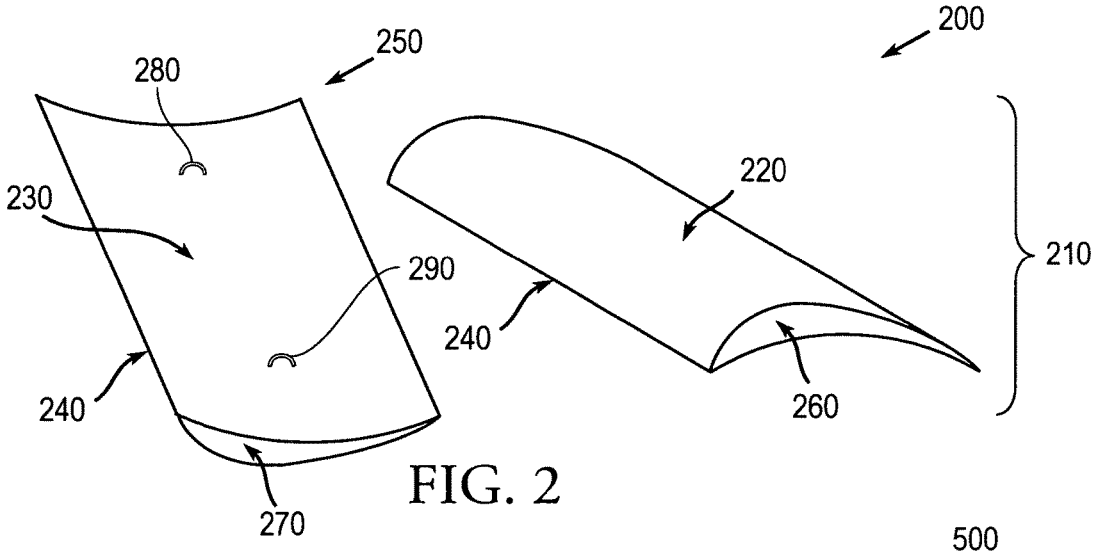
FIG. 2 is an isometric view of an exemplary concatenated airfoil.

FIG. 2 shows elevation views 200 of exemplary airfoils 210. The right airfoil 210 reveals an outer surface 220 that presents a camber profile for aerodynamic lift, while the left airfoil 210 reveals an inner surface 230 that presents a circular arc section that conforms to the axi-symmetric curvature of the housing sections 120 and 130. Boundaries of the airfoils 210 include leading edge 240, trailing edge 250, port tip 260 and starboard tip 270.

Wing grapples 280 and 290, shown as loops, can be disposed on the inner surface 230 towards the corresponding tips 260 and 270. The airfoils 210 are shown to have an aspect ratio of length to chord of about 2:1, although other proportions can be envisioned without departing from the scope of the invention. The airfoils 210 can be composed of an appropriate light-weight stiff polymer material, such as polypropylene, polystyrene, polyvinylchloride and polychlorotrifluoethylene.

Figure 3:
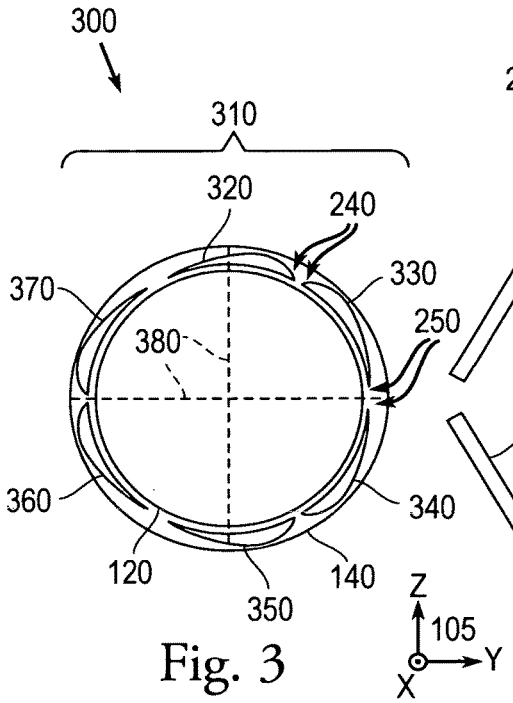
FIG. 3 is an elevation axial cross-section view of a recess section with stowed airfoils.

FIG. 3 shows an elevation axial view 300, indicated by the compass rose 105 as facing aft, of the housing section 110 with stowed wings 210. A missile segment 310 is shown with multiple airfoils 210 in the stowed configuration. Listed in clockwise direction, these include top airfoil 320, upper port airfoil 330, lower port airfoil 350, lower starboard airfoil 360 and upper starboard airfoil 370. The top, lower port and lower starboard airfoils 320, 340 and 360 have leading edges 240 that face clockwise.

The upper port, bottom and upper starboard airfoils 330, 350 and 370 have leading edges 240 that face anti-clockwise. Bilateral lines 380 denote vertical and horizontal planes of symmetry for the missile portion 110. Exemplary embodiments incorporate an even plurality of such wings 210 angularly disposed around the housing section 120.

Figure 4:
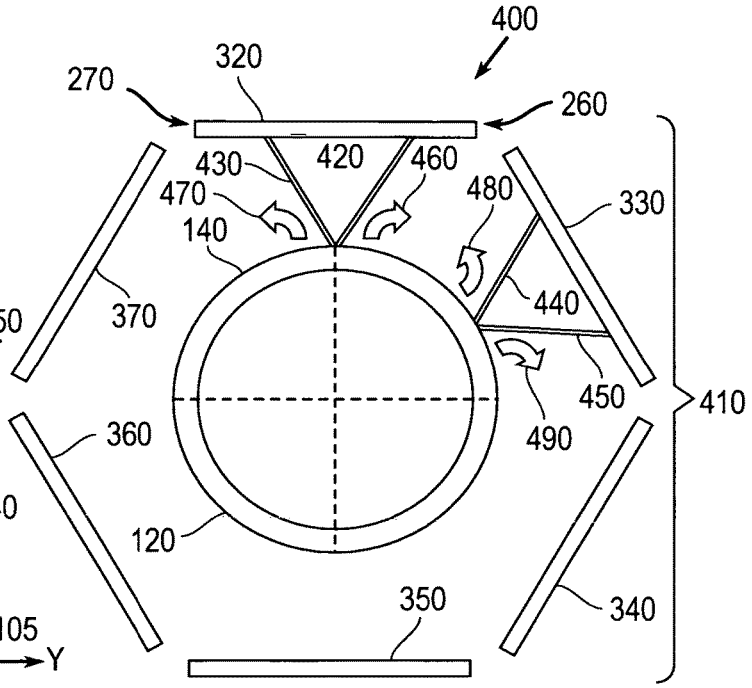
FIG. 4 is an elevation axial cross-section view of the recess section with deployed airfoils.

FIG. 4 shows an elevation axial view 400 of the housing section 120 with deployed wings 210. A missile segment 410 is shown with multiple wings 210 as deployed to envelop the housing section 120 at a radial distance. The missile segment 410 represents either of recess housing sections 120 and 130 together with the corresponding fore and aft fuselage portion. Anchor lanyards on the fore left 420 and aft right 430 secure the clockwise facing airfoils 320, 340 and 360. Anchor lanyards on the fore right 440 and aft left 450 secure the anti-clockwise facing airfoils 330, 350 and 370. These lanyards 420, 430, 440 and 450 may be slack during wing stowage and become taut upon release during deployment. The lanyards 420, 430, 440 and 450 may be composed of a flexible cord material, such as Nylon, Kevlar or other appropriate polymer.

As the airfoils deploy, the clockwise airfoils 320, 340 and 360 translate radially outward and twist rotationally clockwise as shown by arrows 460 (towards left) and 470 (towards right) for their respective port and starboard tips 260 and 270. Similarly, the anti-clockwise airfoils 330, 350 and 370 translate radially outward and swing rotationally anti-clockwise as shown by arrows 480 (towards right) and 490 (towards left) for their respective port and starboard tips 260 and 270.

Artisans will recognize that the hexagonal configuration is representative of an exemplary embodiment, and is thus not limiting, in that other even quantities of wings circumferentially arranged around a missile body can be employed. Preferably a number between four and twelve wings, depending on design considerations, are envisioned. Fewer than four wings 210 entail arc curvature on the inner surface 230 that interfere with twist during deployment. More than twelve wings 210 risk excess tension from longer lanyards 420, 430, 440 and 450, as well as reduced lift from shortened chords.

Figure 5:
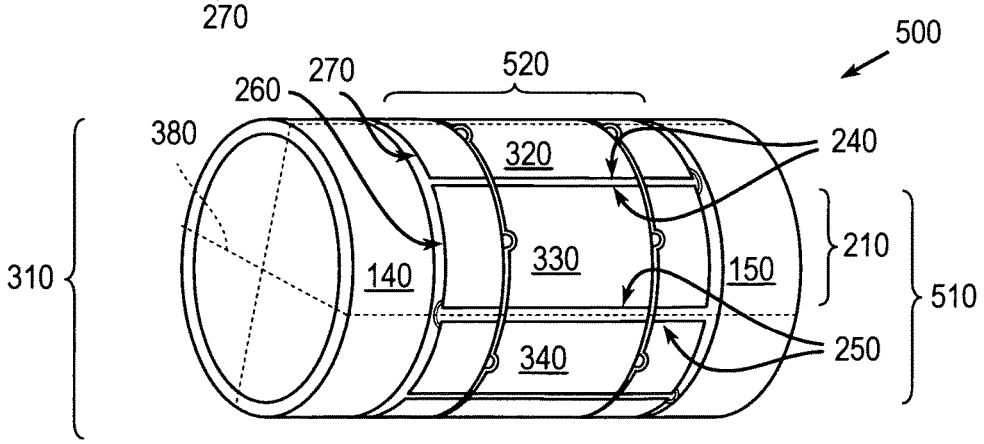
FIG. 5 is an isometric view of the recess section with stowed airfoils.

FIG. 5 shows an isometric view 500 of the housing section 120 with stowed airfoils 210 as the missile segment 310. The facing wing pair set 510 denotes anti-clockwise and clockwise facing airfoils, in this example facing their trailing edges 250 for illustrative purposes. In the stowed configuration, the leading edge 240 of the upper port airfoil 330 faces the leading edge 240 of the lower port airfoil 340. Similarly, the trailing edge 250 of the upper port airfoil 330 faces the trailing edge 250 of the top airfoil 330.

Figure 6:
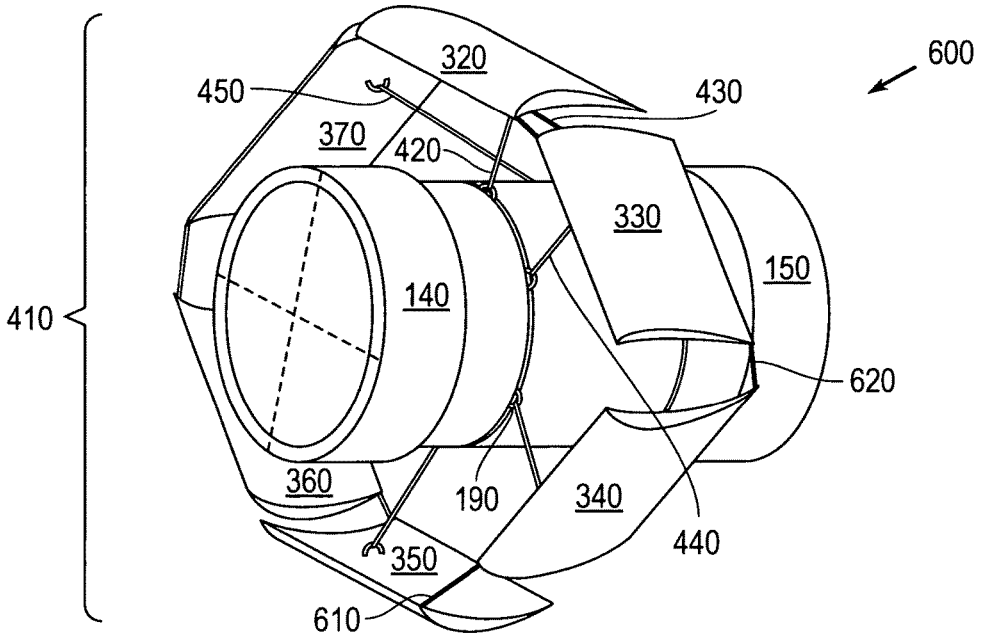
FIG. 6 is an isometric view of the recess section with deployed airfoils.

FIG. 6 shows an isometric view 600 of the housing section 120 with deployed airfoils 210 as the missile segment 410. A fore tip cord 610 joins the leading edges 240 of the top and upper port airfoils 320 and 330. An aft tip cord 620 joins the trailing edges 250 of the upper port and lower port airfoils 330 and 340. Similar fore and aft tip cords 610 and 620 respectively join the remaining leading and trailing edges 240 and 250 of other facing wing pairs 510. The cords 610 and 620 are presumed to be flexible, being slack while the wings are stowed and taut upon deployment. This wing expansion for deployment resembles the process of the WSU-17/B annular blast fragmentation warhead that deploys two-hundred titanium rods for the AIM-9 Sidewinder missile.

Figure 7:
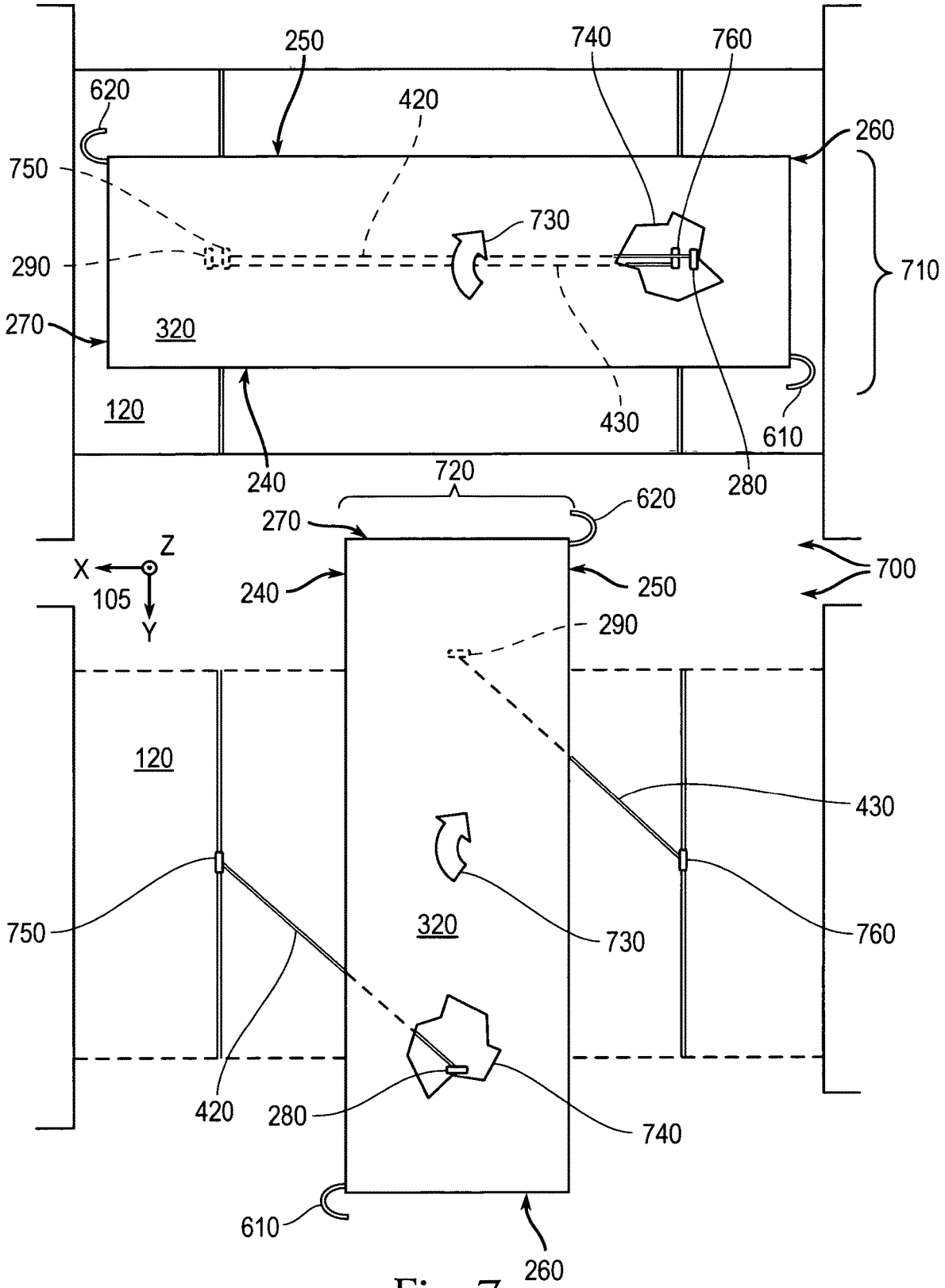
FIG. 7 is plan detail view of the recess section with one airfoil in stowed and deployed configuration.

FIG. 7 shows plan views 700 of the housing section 120, indicated by the compass rose 105 as facing down, with the top airfoil 320 as disposed respectively in stowed and deployed configurations 710 and 720. A rotation arrow 730 shows the clockwise swing direction of the clockwise facing airfoils 320, 340 and 360 to enable their leading edges 240 to face forward upon deployment. Similarly, the anti-clockwise airfoils 330, 350 and 370 swing in the opposite direction so that their leading edges 240 face forward accordingly. The fore tip cord 610 connects adjacent airfoils 320 and 330 together. The aft tip cord 620 connects adjacent airfoils 320 and 370 together.

A cutout region 740 on the top airfoil 320 reveals a front anchor 750, while a rear anchor 760 remains obscured as denoted by hash outline. The front and rear anchors 750 and 760, as mainstays 190 in their respective channel bands 170 and 180, secure the wings 210 to the housing section 120, with the clockwise example top airfoil 320 as shown, although the same conditions remain valid for the anti-clockwise airfoils. The fore anchor lanyard 420 connects the front anchor 750 in tension with the port wing grapple 280. The rear anchor lanyard 430 connects the rear anchor 760 in tension with the starboard wing grapple 290. During stowage, the lanyards 420 and 430 can optionally both attach to the anchors 750 and 760 to augment their lengths. Releasable latches on the mainstays 190 (both anchors 750 and 760) enable the lanyards 420, 430, 440 and 450 to extend outward in order to deploy the wings 210.

Aerodynamic drag forces while the missile operates in flight would push the airfoils rearward, although the resulting displacement could be compensated by stiffening the lanyards 420, 430, 440 and 450. Additional brace ties could be incorporated to connect auxiliary wing hooks (not shown) at the leading and trailing edges to the corresponding front and rear anchors 750 and 760 connected by lines with adjustable lengths to enable the bottom airfoil 350 to exhibit an angle of attack for increased lift.

Figure 8:
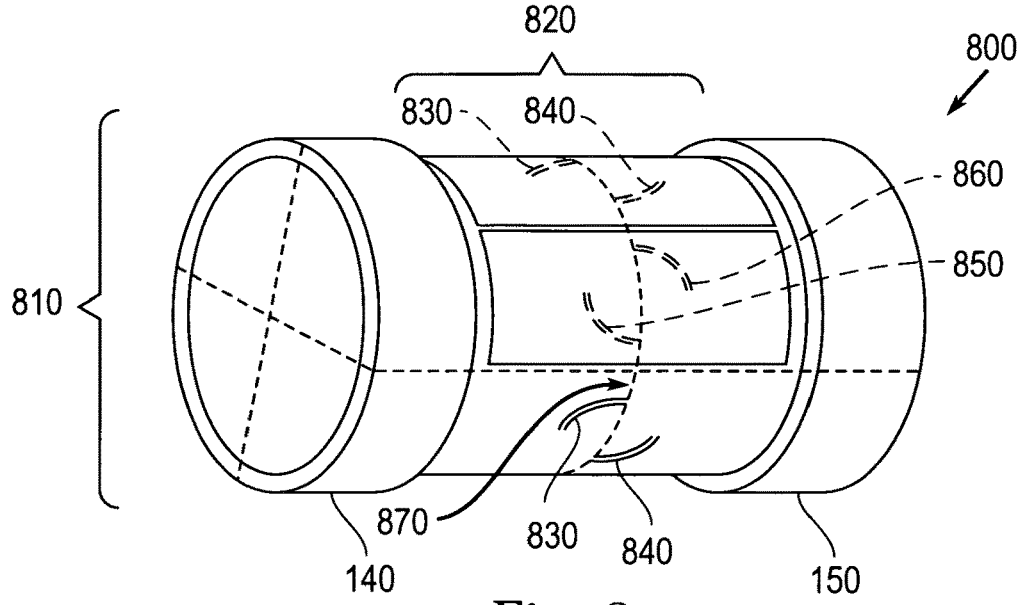
FIG. 8 is an isometric view of the recess section with stowed airfoils.

Instead of flexible lanyards, rigid rods or struts present an alternative technique for securing the wings 210 to the housing sections 120 and 130. FIG. 8 shows an isometric view 800 of a missile segment 810 having an alternate housing section 820 with select stowed airfoils 210. The housing section 820 as shown includes top and upper port airfoils 320 and 330, along with arc tracks 830, 840, 850 and 860 thereon. The clockwise tracks 830 and 840 face the clockwise airfoils 320, 340 and 360. The anti-clockwise tracks 850 and 860 face anti-clockwise airfoils 330, 350 and 370. The arc tracks 830, 840, 850 and 860 can be envisioned as guide rails or alternatively as grooves on the cylindrical surfaces of the housing section 820.

Figure 9:
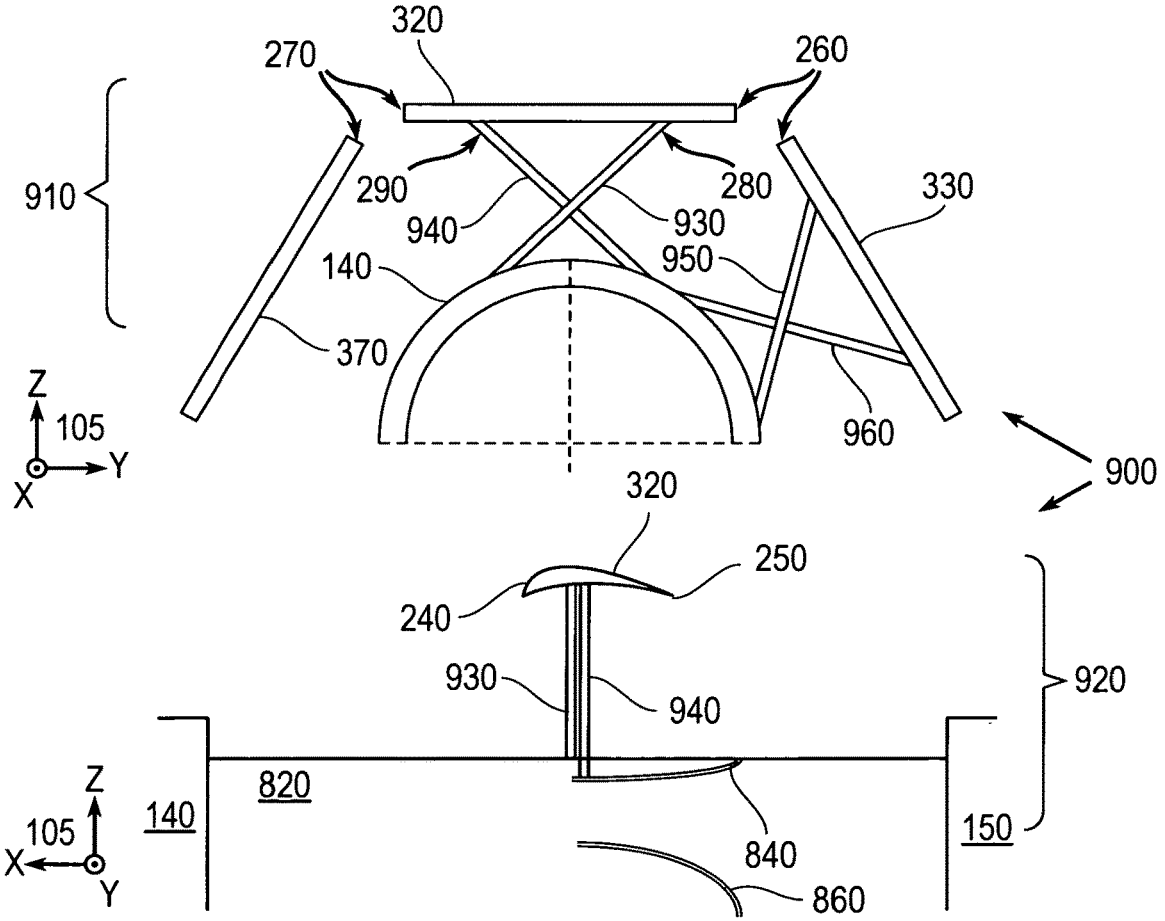
FIG. 9 is a set of elevation views of the recess section with deployed airfoils.

FIG. 9 shows aft facing and side facing elevation views 900 of the missile segment 820 with deployed airfoils 210 as the deployed airfoil section from front 910 and from side 920. Upon deployment, the clockwise airfoils 320, 340 and 360 pivotably attach to the missile segment 820 by clockwise struts 930 and 940 respectively to port and starboard grapples 280 and 290 on the respective airfoil inner surfaces 230. Similarly, the anti-clockwise airfoils 330, 350 and 370 connect by anti-clockwise struts 950 and 960 to starboard and port grapples 290 and 280. The fore struts 930 and 950 cross in front of the aft struts 940 and 960. The struts 930, 940, 950 and 960 can be composed of a structurally rigid and elastic material. Metal (such as a steel alloy) or other suitable substance (e.g., carbon phenolic) in order to engage the airfoils 210 against aerodynamic drag while the missile operates in flight.

Figure 10A:
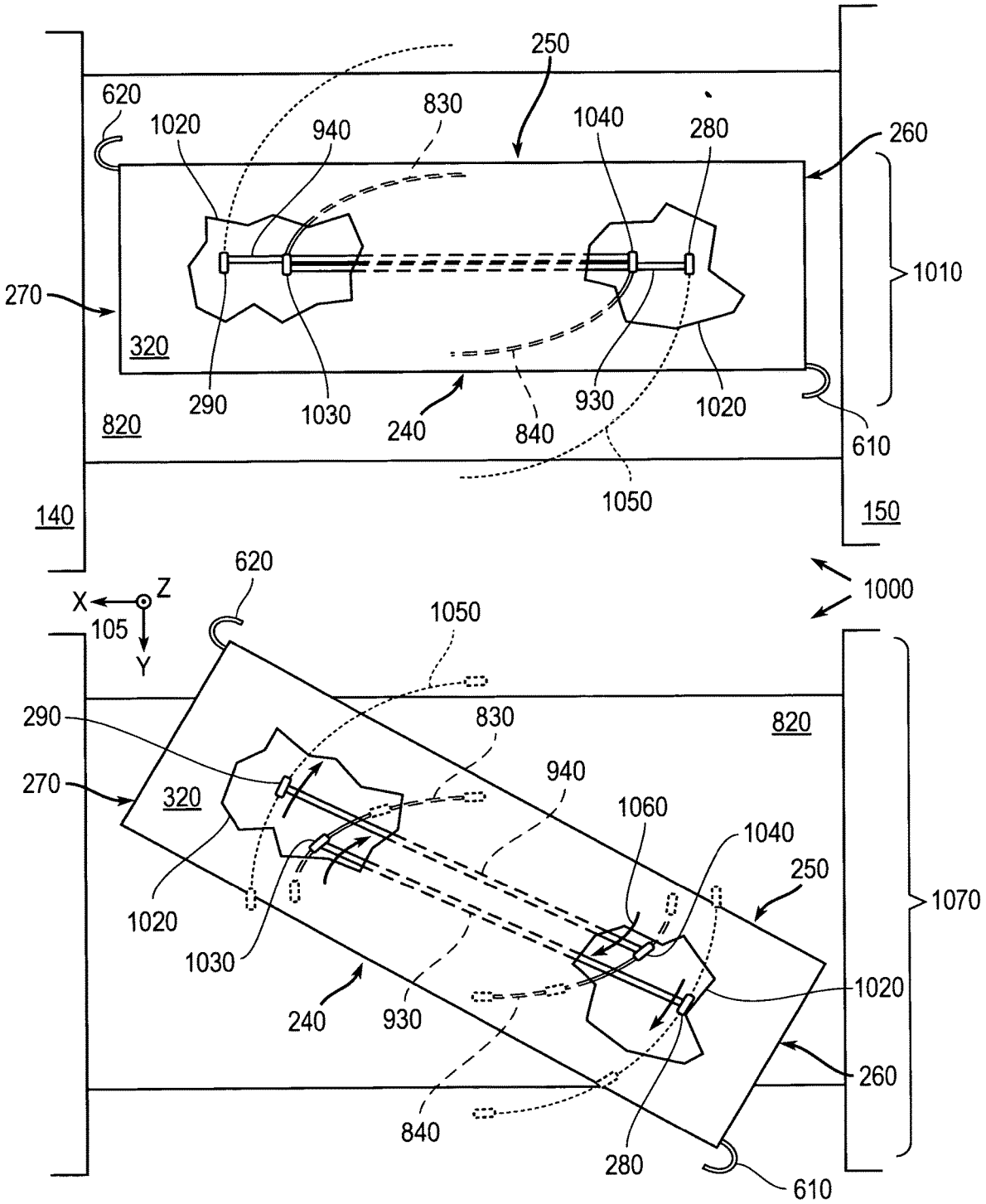
FIGS. 10A and 10B are plan detail views of the recess section with one airfoil in stowed and deployed configuration.
Figure 10B:
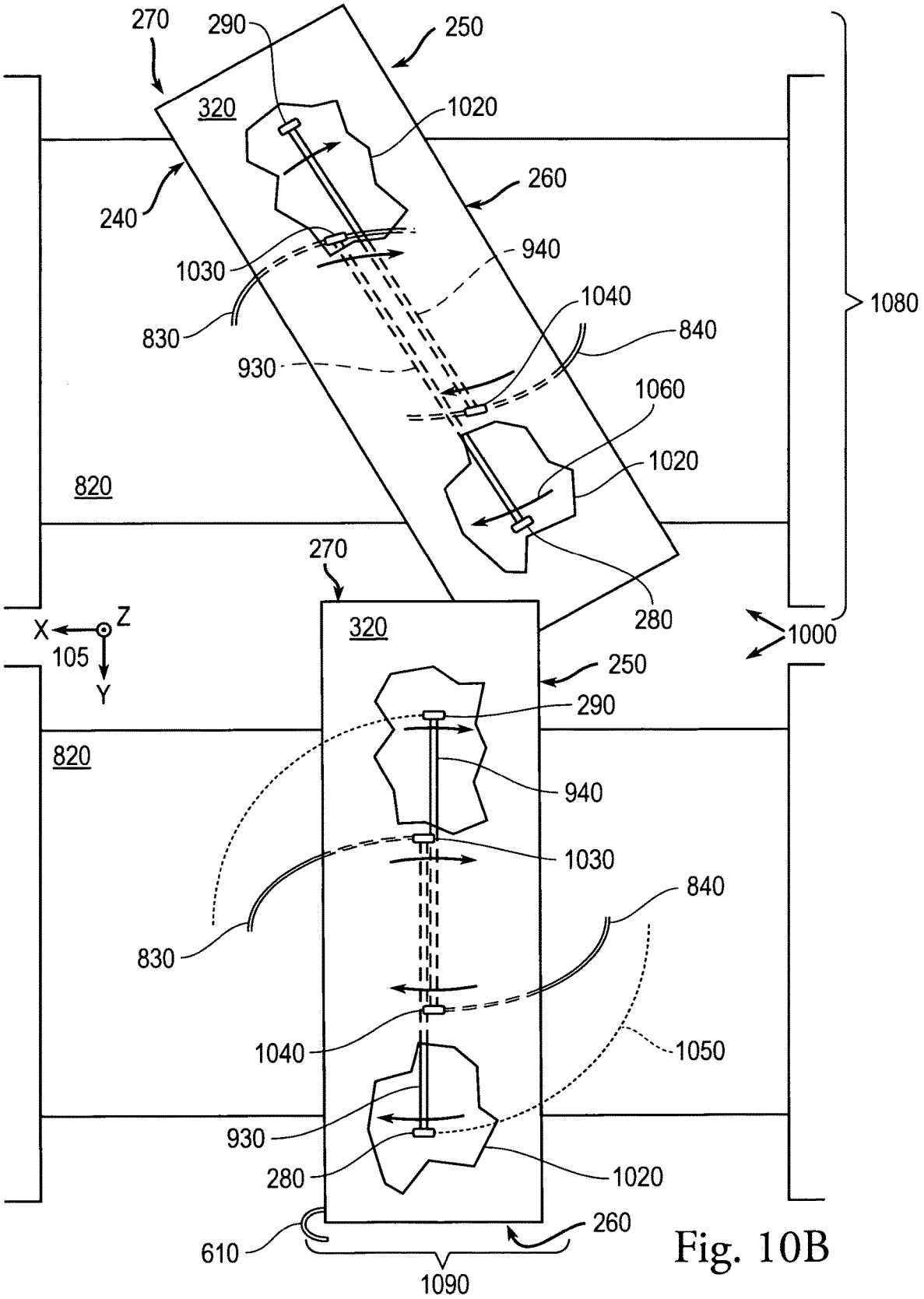

FIGS. 10A and 10B show plan views 1000 of the housing section 820, indicated by the compass rose 105 as facing down, with the top airfoil 320 as disposed as being deployed, with stowed configuration 1010 analogous to view 800. Cutout regions 1020 reveal portions of the arc tracks 830 and 840, the struts 930 and 940, the grapples 280 and 290, as well as pin joints 1030 and 1040. The clockwise arc tracks 830 and 840 can constitute grooves on the housing section 820 to enable the pin joints 1030 and 1040 to slide therealong.

The stowed configuration 1010 shows the fore left strut 930 aligned on the front starboard track 830 and connecting to the port grapple 280, as well as the aft right strut 940 aligned on the rear port track 840 and connecting to the starboard grapple 290. A hash arc 1050 denotes the swing path of the grapples 280 and 290 as the airfoil 320 deploys. The tip chords 610 and 620 connect to adjacent airfoils as in view 700.

Direction arrows 1060 in the initial release phase configuration 1070 indicate respective movements of the grapples 280 and 290, as well as the pin joints 1030 and 1040. Phantom positions in hash outline of these markers identify example past and future positions along their respective paths. The configuration 1070 reveals the airfoil 320 has swung out clockwise by about 30° from stowage, with the fore and aft struts 930 and 940 moving apart. In the subsequent phase configuration 1080, the fore and aft struts 930 and 940 move closer together as the airfoil 320 has swung out clockwise by about 60° from stowage. The remaining clockwise airfoils 340 and 360 behave in a similar manner. The anti-clockwise airfoils 330, 350 and 370 operate with fore and aft struts 950 and 960 to swing out in opposite direction.

A missile corresponding to Tomahawk size would have a circumference of 1.63 m, which yields a wing chord of 0.25 m for six airfoils. Assuming a wing span for each deployed airfoil of 0.5 m, this provides an area of 0.125 $m^2$ (square meter). The top and bottom airfoils are horizontal, while the adjacent airfoils slant at 60° from horizontal, thereby offering $\cos(\frac{2}{3}\pi)=\frac{1}{2}$ or half the available area. The six concatenated annular wings in a single wing set would enable an effective horizontal wing area of $2\times0.125\times(2+4\times\frac{1}{2})=1.0\ m^2$.

The Tomahawk wing span is 2.67 m, so subtracting the missile diameter of 0.62 m leaves an effective length of 2.05 m. For an estimated average chord of 0.3 m, the Tomahawk effective wing area is estimated for these purposes at 0.61 $m^2$. The exemplary configuration for one annular wing set would increase lift surface over the conventional Tomahawk design by 63%, and for twin tandem sets by 225%. Twin tandem sets could be expected to provide better pitch stability than a single set of airfoils.

An added benefit of the exemplary airfoils includes enablement of banking without loss of lift due to the axi-symmetric configuration of the deployed wings. Corresponding values for the Harpoon would exhibit linear dimensions about 35% smaller than for Tomahawk. Because the folded wings on the Harpoon do not insert into the fuselage as those of Tomahawk, recess for the housing sections 120 and 130 may be unnecessary for incorporation of exemplary annular wing sets. A four-wing arrangement could accommodate the AGM-86 Air-Launched Cruise Missile (ALCM) and the AGM-154 Joint Standoff Weapon (JSOW), albeit with an inner surface 230 having a non-cambered planar profile disposed over their rounded rectangular cross-sections.

Effective lift can be estimated by the equation for lift: $L=\frac{1}{2}\ c\cdot\rho\cdot A\cdot V^2$, where c is the lift coefficient estimated at 0.25 at zero angle of attack, ρ is air density of 1.225 $kg/m^3$, A is wing area of 2.0 m for two concatenated wing sets, and V is velocity at 247 m/s. From this, resulting lift is 18.7 kN (kiloNewtons), which slightly exceeds the gravitational force on the Tomahawk missile.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A concatenated annular swing-wing tandem lift enhancer (CASTLE) for augmenting aeronautical lift to a canister-launched missile, said CASTLE comprising:

fore and aft housing sections configured to be disposed circumferentially around the missile along a longitudinal axis of symmetry;

a plurality of front and rear mainstays disposed angularly along each housing section;

an even plurality of airfoils stowed circumferentially around each said housing section, each airfoil having an outer camber surface and an inner arc surface that provides leading and trailing edges ending at port and starboard tips;

a plurality of wing grapples disposed on said inner arc surface in proximity to said port and starboard tips; and a plurality of tension supports that connect said mainstays to corresponding said grapples such that said plurality of airfoils deploys radially outward and swings such that each leading edge faces forward in relation to the longitudinal axis.

2. The CASTLE according to claim 1, wherein said tension supports constitute lanyards that each flexibly connects one of said mainstays to a corresponding one of said grapples.

3. The CASTLE according to claim 1, wherein said housing sections include arc tracks for said mainstays to slide along; and said tension supports constitute rigid struts that pivotably connect associated said mainstays to corresponding said grapples.

4. The CASTLE according to claim 1, wherein said housing sections are configured to be recessed into the missile.

5. The CASTLE according to claim 1, wherein adjacent ones of said airfoils are joined by tip cords that connect one of adjacent leading edges and adjacent trailing edges together.

6. The CASTLE according to claim 1, wherein said even plurality of airfoils is between four and twelve, inclusive.

* * * * *